US007275726B2

(12) United States Patent
Tusting et al.

(10) Patent No.: US 7,275,726 B2
(45) Date of Patent: Oct. 2, 2007

(54) ACTIVE CAMMING DEVICE SURFACE

(75) Inventors: Paul Tusting, Salt Lake City, UT (US); Bill Belcourt, Salt Lake City, UT (US); Joe Skrivan, Draper, UT (US); Dave Mellon, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 130 days.

(21) Appl. No.: 11/021,006

(22) Filed: Dec. 22, 2004

(65) Prior Publication Data

US 2005/0161566 A1 Jul. 28, 2005

Related U.S. Application Data

(60) Provisional application No. 60/538,491, filed on Jan. 22, 2004.

(51) Int. Cl.
*A47F 5/08* (2006.01)

(52) U.S. Cl. ..... 248/231.9; 248/925; 248/231.91; 248/694; 294/94; 294/95; 294/96; 294/28

(58) Field of Classification Search ..... 248/295, 248/231.9, 231.91, 694; 294/94, 95, 96, 294/28

See application file for complete search history.

(56) References Cited

U.S. PATENT DOCUMENTS

| | | | | |
|---|---|---|---|---|
| 2,979,297 A | | 4/1961 | Suozzo | |
| 3,877,679 A | | 4/1975 | Lowe | 254/135 |
| 4,184,657 A | | 1/1980 | Jardine | 248/1 |
| 4,565,342 A | | 1/1986 | Grow | 248/1 |
| 4,572,464 A | | 2/1986 | Phillips | 248/1 |
| 4,575,032 A | | 3/1986 | Taylor | 248/1 |
| 4,643,377 A | | 2/1987 | Christianson | 248/1 |
| 4,643,378 A | | 2/1987 | Guthrie et al. | 248/1 |
| 4,645,149 A | * | 2/1987 | Lowe | 248/231.9 |
| 4,712,754 A | * | 12/1987 | Brodie | 248/231.9 |
| 4,781,346 A | | 11/1988 | Banner | 248/1 |
| 4,832,239 A | | 5/1989 | Andersson | 223/95 |
| 4,834,327 A | * | 5/1989 | Byrne | 248/231.9 |
| 4,923,160 A | | 5/1990 | Waggoner | 248/200 |

(Continued)

FOREIGN PATENT DOCUMENTS

| | | |
|---|---|---|
| GB | 2369068 | 5/2002 |

(Continued)

*Primary Examiner*—Carl D. Friedman
*Assistant Examiner*—Nkeisha J. Dumas
(74) *Attorney, Agent, or Firm*—Trent H. Baker; Baker & Associates PLLC

(57) ABSTRACT

The present invention relates to an active camming device including a plurality of non-flat camming surfaces. In accordance with the present invention, the opposing camming surfaces are shaped to include substantially concave and convex surfaces respectively. In one embodiment, each individual cam lobe is shaped in a substantially concave or convex manner to form a cam surface. In another embodiment, a plurality of cam lobes disposed on a single side of a device, are shaped to provide a combined substantially concave or convex surface. The convex surface or surfaces are always disposed opposite of the concave surface or surfaces to provide an increased stability in uneven recesses. Non-flat camming surfaces increase the stability of a camming device in irregular recesses by increasing the number of connection points between the device and the recess.

43 Claims, 6 Drawing Sheets

U.S. PATENT DOCUMENTS

| | | | | |
|---|---|---|---|---|
| 6,375,139 | B1 * | 4/2002 | Murray | 24/231.9 |
| 7,014,156 | B2 * | 3/2006 | Apezetxea et al. | 248/231.9 |
| 7,140,583 | B2 * | 11/2006 | Petzl | 248/231.9 |
| 2003/0057337 | A1 * | 3/2003 | Brown | 248/231.9 |

FOREIGN PATENT DOCUMENTS

| | | |
|---|---|---|
| GB | 2380949 | 4/2003 |

* cited by examiner

ACTIVE CAMMING DEVICE SURFACE

RELATED APPLICATIONS

This application claims priority to U.S. Provisional Application Ser. No. 60/538,491 filed Jan. 22, 2004, entitled "ACTIVE CAMMING SURFACE".

TECHNICAL FIELD

The present invention relates to an active camming device including a plurality of non-flat camming surfaces.

BACKGROUND

Climbers generally use clean protection devices for two distinct purposes. First, a clean protection device may be used as a form of safety protection for protecting a climber in the event of a fall and second, a clean protection device may intentionally be used to artificially support a climber's weight. Clean protection devices cam or wedge into a crack, hole, gap, orifice, taper, or recess in order to support an outward force. The area or surface within which the clean protection device supports the outward force is considered the protection surface. The protection surface can consist of natural materials such as rock or may consist of artificial materials such as concrete.

Clean protection devices are generally divided into active and passive categories. Passive protection devices include a single object, which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable objects that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection devices is camming devices. These devices translate rotational displacement into linear displacement. Therefore, a slider chock would not be an active camming device because the two wedges simply slide relative to one another and do not rotate. Camming devices include two, three, and four cam lobe devices. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

Active protection devices are generally preferable to passive protection devices because of their ability to cam into a variety of features. For example, a standard four-cam unit has a particular camming range that allows it to cam into features within a particular size range. Whereas, a passive protection device is limited to a single shape and can therefore only cam or wedge into features that conform to that particular shape. Unfortunately, the largest disadvantage of active protection devices is their considerable head width in relation to passive protection devices. Head width is defined as the maximum distance in the direction of the axle or axles longitudinal axis. Most camming devices contain three or four cam lobes. These cam lobes are typically driven by torsion springs on the axle. The large head width is primary made up of the cam lobes, the torsion springs, and the cable terminal or terminals.

Another advantage of camming devices over passive protection devices is their ability to protect awkward, flaring, and otherwise irregular cracks. This is a result of the cam lobes having independent action allowing them to adjust to the irregularities of the crack.

Traditional active camming devices include camming surfaces which are substantially flat. The camming surface is defined as the portion of the active camming device which engages the crack or recess. Generally, the camming surface is the outer part of one or more cam lobes. Substantially flat camming surfaces are designed to increase friction between the device and the recess within which it is engaged. Friction is necessary between the active camming device and the recess so that the device is not able to slide out. However, some irregularly shaped recesses may cause camming devices with flat camming surfaces to wobble due to a low number of contact points. This wobbling or instability could also cause an active camming device to fail or release from a placement. For at least these reasons, there is a need in the industry for a more stable camming surface design that is applicable to all camming devices.

SUMMARY

The present invention relates to an active camming device including a plurality of non-flat camming surfaces. In accordance with the present invention, the opposing camming surfaces are shaped to include substantially concave and convex surfaces respectively. In one embodiment, each individual cam lobe is shaped in a substantially concave or convex manner to form a cam surface. In another embodiment, a plurality of cam lobes disposed on a single side of a device, are shaped to provide a combined substantially concave or convex surface. The convex surface or surfaces are always disposed opposite of the concave surface or surfaces to provide an increased stability in uneven recesses. Non-flat camming surfaces increase the stability of a camming device in irregular recesses by increasing the number of connection points between the device and the recess.

The embodiments described above may also be combined in any manner to create additional embodiments. The foregoing and other features, utilities, and advantages of the invention will be apparent from the following detailed description of the invention with reference to the accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

DETAILED DESCRIPTION

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

The present invention relates to an active camming device including a plurality of non-flat camming surfaces. In accordance with the present invention, the opposing camming surfaces are shaped to include substantially concave and convex surfaces respectively. In one embodiment, each individual cam lobe is shaped in a substantially concave or convex manner to form a cam surface. In another embodiment, a plurality of cam lobes disposed on a single side of a device, are shaped to provide a combined substantially concave or convex surface. The convex surface or surfaces are always disposed opposite of the concave surface or surfaces to provide an increased stability in uneven recesses. Non-flat camming surfaces increase the stability of a camming device in irregular recesses by increasing the number of connection points between the device and the recess. Also, while embodiments of the present invention are described in the context of an active camming device with non-flat camming surfaces, it will be appreciated that the teachings of the present invention are applicable to other applications as well.

Figure 1:
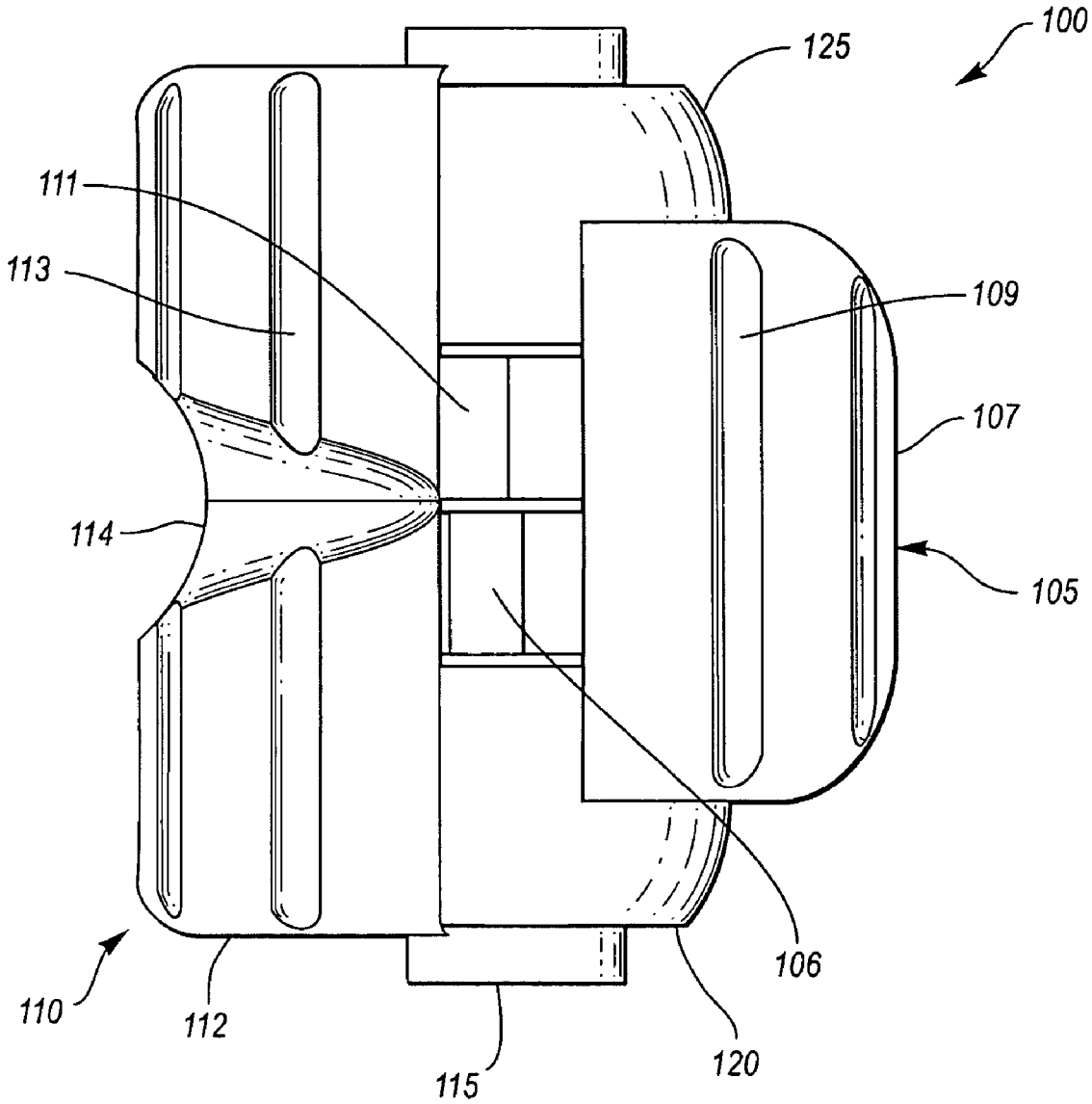
FIG. 1 illustrates a top view of one embodiment of an active camming device in accordance with the present invention, wherein the illustrated active camming device includes two opposing cam lobes.

Reference is initially made to FIG. 1, which illustrates a top view of one embodiment of an active camming device in accordance with the present invention, wherein the illustrated active camming device includes two opposing cam lobes and is designated generally at 100. The illustrated active camming device 100 includes a first cam surface 110, a second cam surface 105, a first terminal 125, a second terminal 120, and an axle 115. The first cam surface 110 further includes a first surface 112, a plurality of grooves 113, a recessed region 114, and a first coupler 111. Likewise, the second cam surface 105 further includes a second surface 107, a plurality of grooves 109, and a second coupler 106. The recessed region 114 and the general curvature of the first surface 112 cause the first cam surface 110 to have an overall concave orientation. Likewise, the general curvature of the second surface 107 causes the second cam surface 105 to have an overall convex orientation. The terms "concave" and "convex" are defined broadly to include but are not limited to curved surfaces, discontinuous stepped surfaces, uneven surfaces, etc. The first and second grooves 113, 109 provide additional camming stability for the active camming device 100. The first and second couplers 111, 106 are configured to couple the first and second cam surfaces 110, 105 to the axle 115 in the manner shown. The axle 115 is then coupled to the remainder of the active camming device (not shown) via the two terminals 125, 120. The various components of an active camming device are well known to those skilled in the art and will therefore not be described in detail in this application. In addition, various types of active camming devices can be utilized with the teachings of the present invention.

In the illustrated embodiment, the geometry of the first and second cam surfaces 110, 105 causes the active protection device 100 to contact a recess in at least three locations regardless of the shape of the recess. The stability and reliability of an active cam placement often depends on the number of contact points between the active camming device and the recess. By ensuring that the active camming device 100 always contacts a recess in at least three locations, a minimum level of stability and reliability is created. This increased stability in a recess or orifice will be described in more detailed with reference to FIGS. 4A and 4B.

Figure 2A:
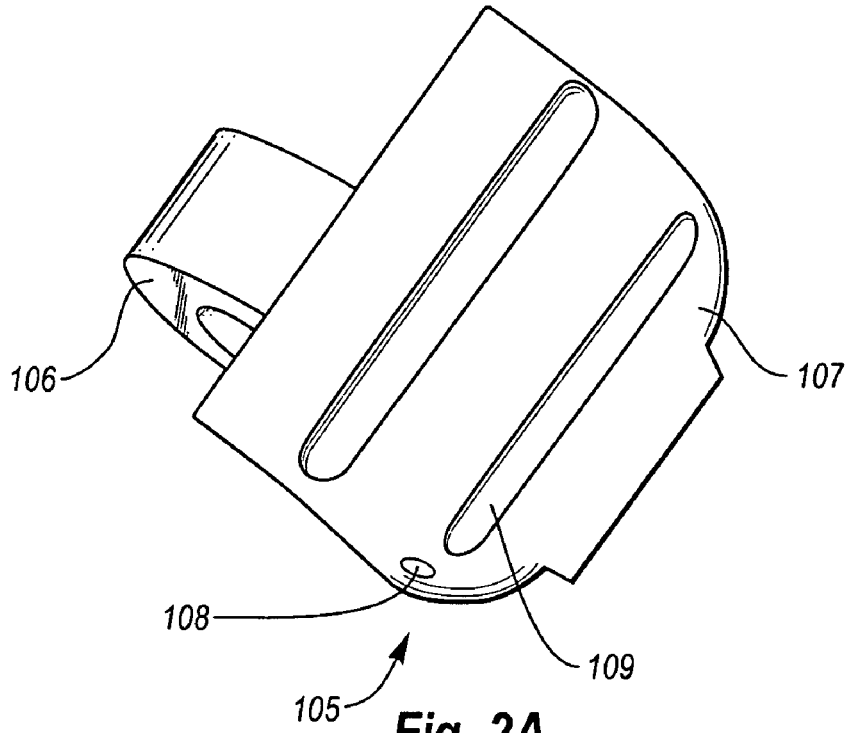
FIGS. 2A-2B illustrate perspective views of the first and second cam surfaces of the active camming device illustrated in FIG. 1.
Figure 2B:
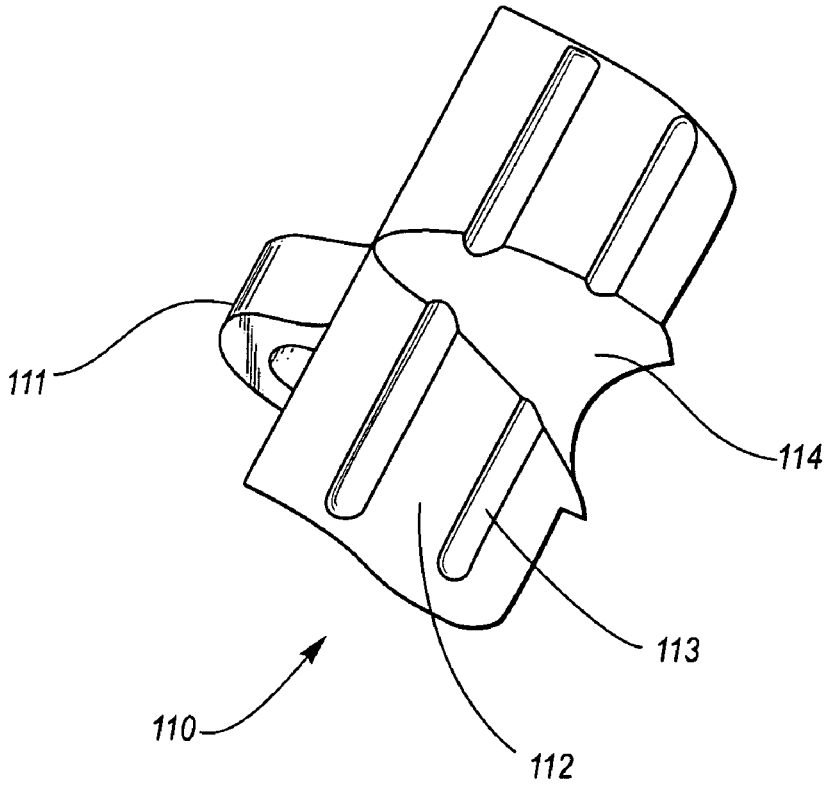

Reference is next made to FIGS. 2A and 2B, which illustrates a perspective view of the second and first cam surfaces 105, 110 respectively, of the active camming device illustrated in FIG. 1. The individual cam surfaces 105, 110 are coupled via the couplers 106, 111 to the remainder of the active camming device 100. The circular orientation of the couplers 106, 111 and the axle 115 (shown in FIG. 1) allow the cam surfaces 105, 110 to rotate about the axle. The couplers 106, 111 are only visible when the cam surfaces 105, 110 are rotated away from one another a certain amount as shown in FIG. 1. FIG. 2A also illustrates a second retractor wire recess 108 which is used as part of a retraction system (not shown) to retract the cam surfaces 105, 110 against a spring bias.

Figure 3:
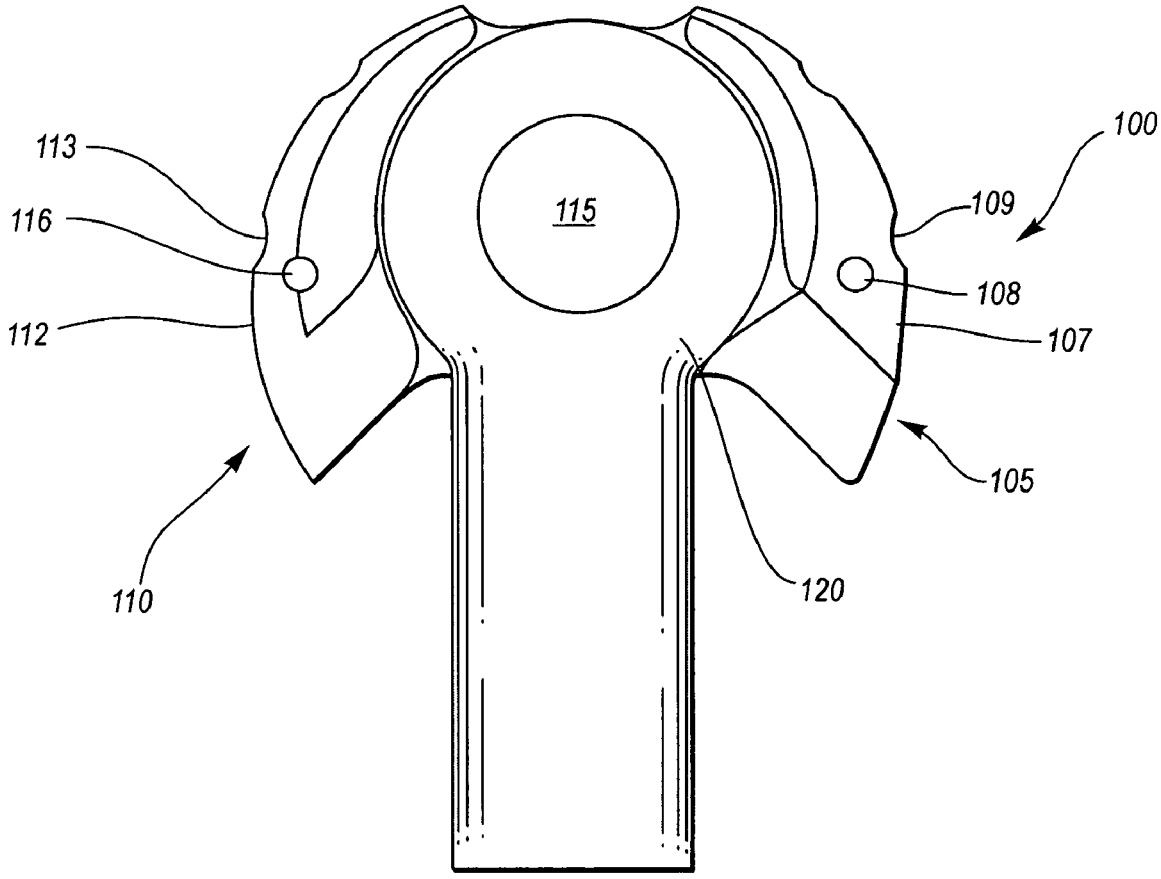
FIG. 3 illustrates a profile view of the active camming device illustrated in FIG. 1.

Reference is next made to FIG. 3, which illustrates a profile view of the active camming device illustrated in FIG. 1. This view clearly illustrates the orientation of the components which allows the cam surfaces 110, 105 to rotate around the axle 115. It is also shown how the terminals 120, 125 couple the axle 115 to the remainder of the active camming device (not shown). The first and second retractor wire recesses 116, 108 are also illustrated. The illustrated embodiment incorporates positioning the retractor wire recesses 116, 108 equidistant from the terminal 120 such that a retraction system (not shown) could be used to equally retract both cam surfaces 110, 105. Various retraction systems and active camming device designs may be incorporated and remain consistent with the present invention.

Figure 4A:
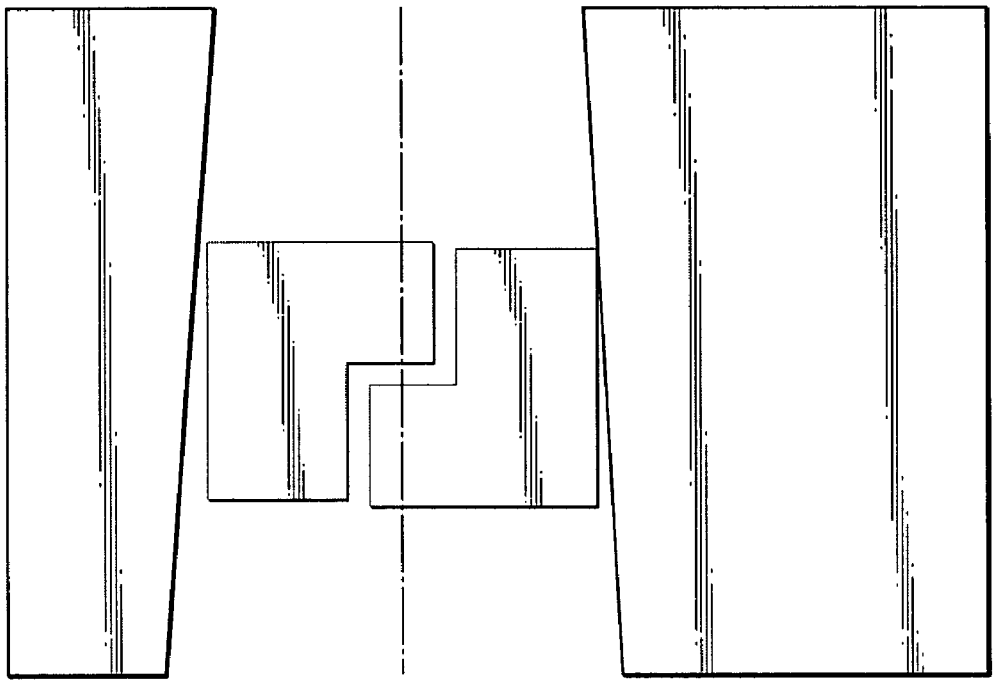
Fig. 4A (Prior Art)
FIGS. 4A-4B illustrate top views of a conventional two cam lobe active camming device and a two cam lobe camming device in accordance with the present invention positioned in an irregular recess.
Figure 4B:
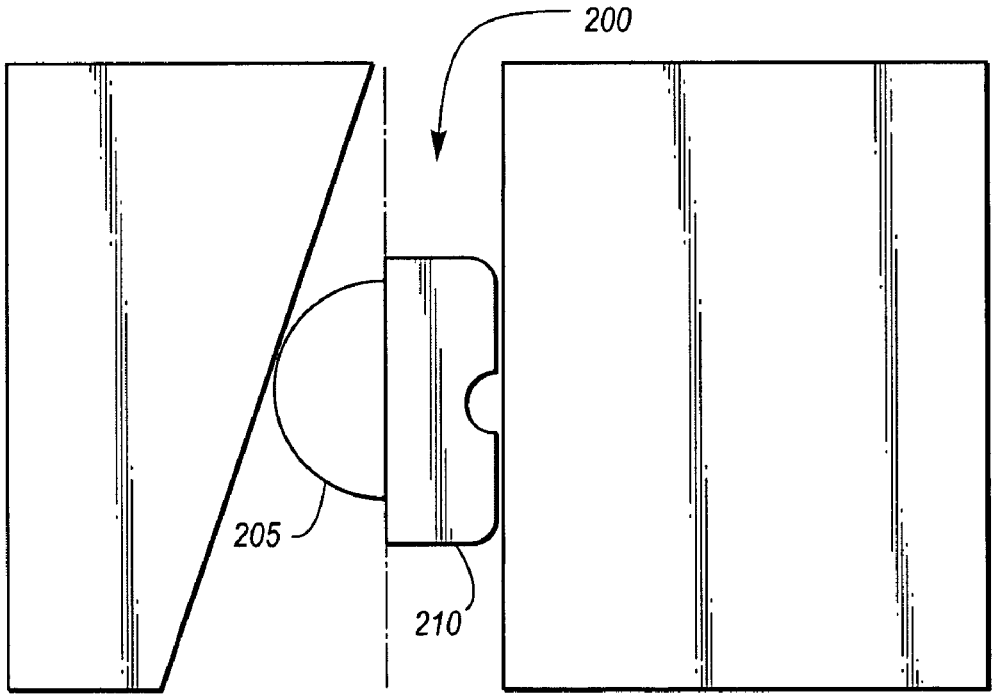

Reference is next made to FIGS. 4A and 4B, which illustrate a top view of a conventional two cam lobe active camming device versus a two cam lobe device in accordance with the present invention. The shapes of the illustrated camming devices in FIGS. 4A and 4B are exaggerated to illustrated the stability concept taught in the present invention. FIG. 4A illustrates how a conventional two cam lobe device with flat camming surfaces will only contact the irregularly shaped recess at two points causing significant rotational stability problems. Traditional active camming devices have flat camming surfaces. Whereas, the two lobe device in accordance with the present invention, designated generally at 200, will automatically contact the recess at least three points. Since the device 200 only has two cam lobes, the outer portion of each cam lobe can be considered the cam surface. The convex cam surface is designated at 205 and the concave cam surface is designated at 210. The convex and concave 205, 210 cam surfaces form a triangle causing the automatic three point contact between the device 200 and the recess.

Figure 5:
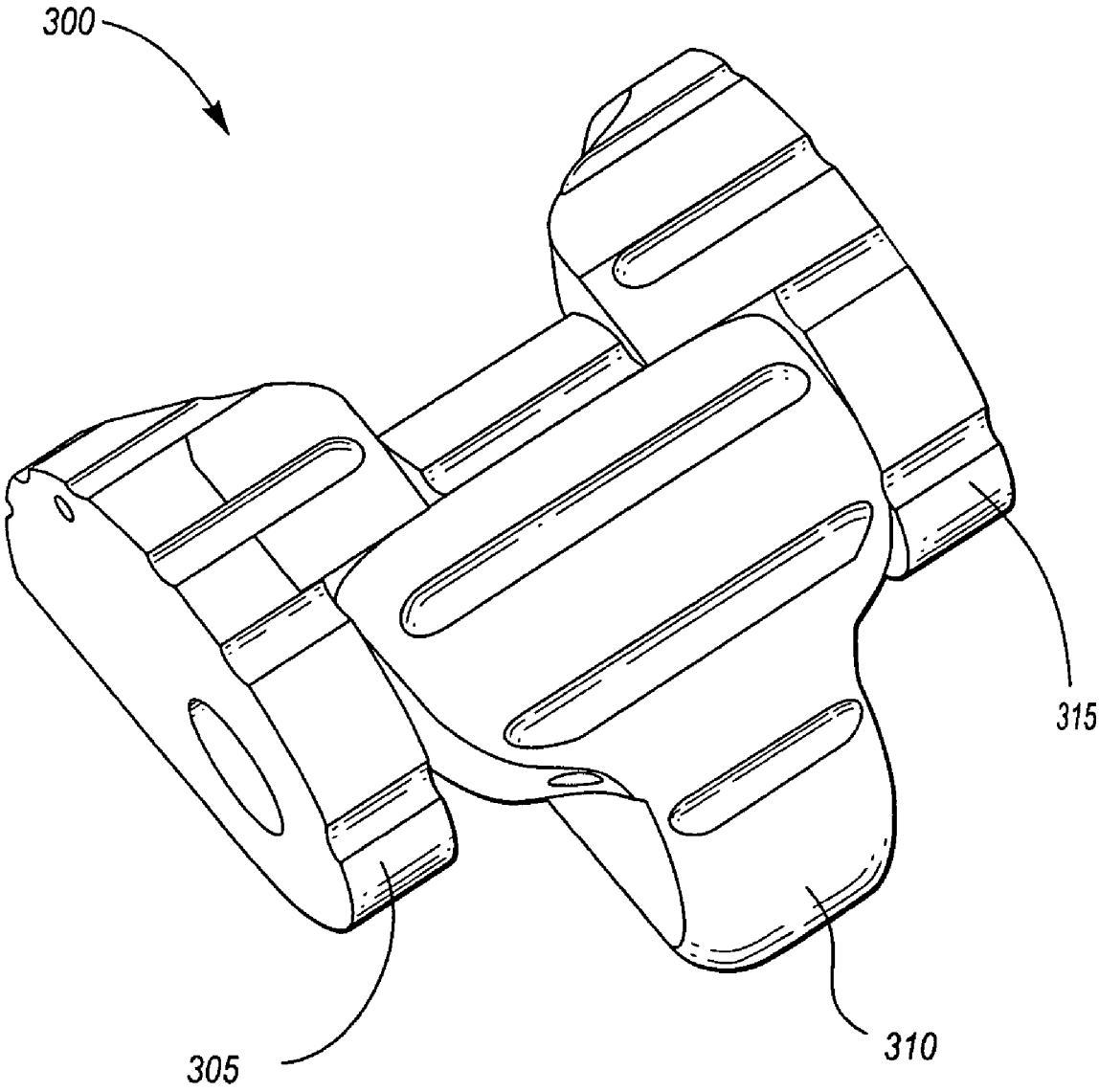
FIG. 5 illustrates a top perspective view of an alternative embodiment of an active camming device in accordance with the present invention, wherein the illustrated active camming device includes three cam lobes.

Reference is next made to FIG. 5, which illustrates a top perspective view of an alternative embodiment of an active camming device in accordance with the present invention, wherein the illustrated active camming device is a single axle device which includes three cam lobes. The alternative embodiment is designated generally at 300 and further includes a first cam lobe 305, a second cam lobe 310, and a third cam lobe 315. The first and third cam lobes 305, 315 together form a concave cam surface. The second cam lobe 310 independently forms a convex cam surface opposite to the concave cam surface formed by the first and third cam lobes 305, 315. This embodiment illustrates how simply curving the surfaces of a traditional active camming device can create opposing concave and convex camming surfaces.

Figure 6:
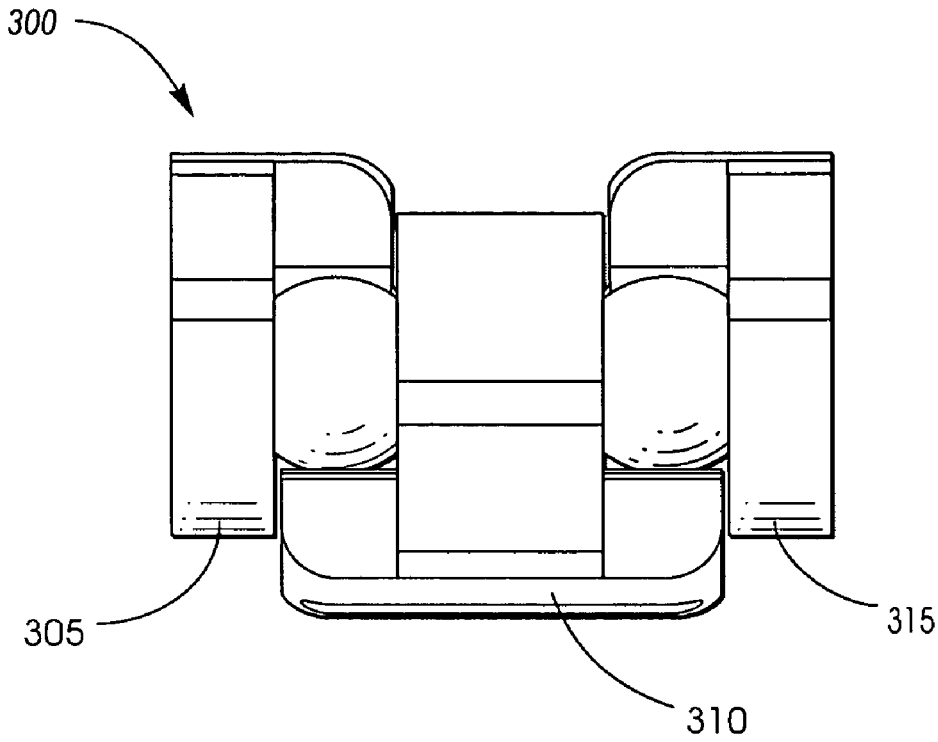
FIG. 6 illustrates a top retracted view of the embodiment illustrated in FIG. 5.

Reference is next made to FIG. 6, which illustrates a top retracted view of the embodiment illustrated in FIG. 5. The curved edges of the cam lobes 305, 310, 315 are clearly illustrated.

Figure 7:
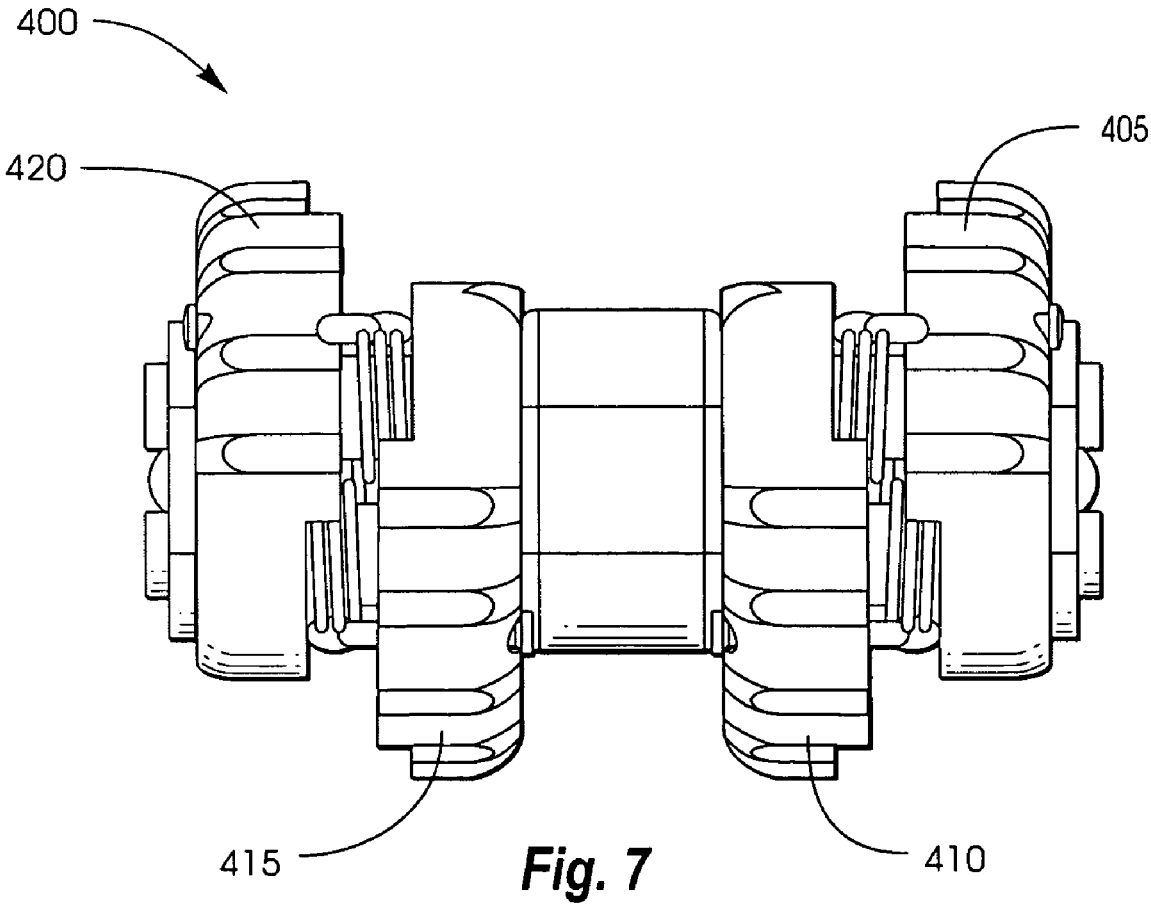
FIG. 7 illustrates a top view of another alternative embodiment of an active camming device in accordance with the present invention, wherein the illustrated active camming device includes four cam lobes.

Reference is next made to FIG. 7, which illustrates a top view of another alternative embodiment of an active camming device in accordance with the present invention, wherein the illustrated active camming device includes four cam lobes and utilizes a dual axle design. The illustrated device is designated generally at 400. The illustrated embodiment is a dual axle CAMALOT active camming device with modified cam lobes to incorporate the teachings of the present invention. In general, dual axle camming devices provide various advantages over single axle camming devices including increased camming range and passive placement strength. The outer cam lobes 420, 405 are outwardly curved opposite one another to create a combined upper convex cam surface. The edge of the outer cam lobes 420, 420 furthest from the terminal is beveled or curved in the manner shown. Likewise, the inner cam lobes 415, 410 are inwardly curved to create a combined lower concave cam surface. The edge of the inner cam lobes 415, 410 closest to the terminal is beveled or curved in the manner shown. Alternatively, the cam lobes 405, 410, 415, 420 could be stepped or shaped in some other manner to create many of the same properties as a curved surface and remain consistent with the present invention. The illustrated curved camming surfaces on each of the cam lobes 405, 410, 415, 420, increases the ability for each cam lobe to assist in stabilizing the device in an irregular recess. For example, if a recess includes various protrusions and irregularities, a flat camming surface on a conventional cam lobe may only touch a single point. If the single point is a crystal, granite flake, or some other breakable protrusion, the connection between the cam lobe and the single point will provide very little camming strength. Whereas, the illustrated curved surfaces will allow the cam lobes 405, 410, 415, 420 to better accommodate irregularities in a placement and possibly couple with additional points in the recess.

Alternatively, the outer cam lobes 420, 405 could be modified to create a combined upper concave cam surface and the inner cam lobes 415, 410 could be modified to create a combined lower convex cam surface. In addition, by only curving a portion of an existing cam surface, the advantages of opposing concave and convex surfaces are achieved without losing all of the frictional properties of a flat camming surface. Various degrees of flatness and curvature can be incorporated into a camming surface to produce different properties.

It should also be noted that many of the advantages of the present invention can be achieved with only one convex for concave cam surface. For example, on a two cam lobe active camming device, one cam lobe could be traditionally flat while the other is shaped to create a concave cam surface. This single concave or convex cam surface configuration is also applicable to active camming devices with more than two cam lobes.

While this invention has been described with reference to certain specific embodiments and examples, it will be recognized by those skilled in the art that many variations are possible without departing from the scope and spirit of this invention. For example, the teachings of one embodiment may be combined with the teachings of another and remain consistent with the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. An active camming device comprising:

at least one terminal;

a first concave cam surface coupled to the at least one terminal, wherein the first concave cam surface includes a first cam lobe, and wherein the axis of concavity of the first cam surface is substantially parallel to an axis of rotation of the first cam lobe;

a second cam surface coupled to the at least one terminal, wherein the second cam surface is oriented opposite the first concave cam surface;

a connection system coupled to the at least one terminal; and a retraction system coupled to the first concave cam surface and the second cam surface such that the first concave and second cam surfaces are spring biased in a particular position.

2. The active camming device of claim 1, wherein the axis of rotation of the first cam lobe is substantially parallel to the lengthwise orientation of the at least one terminal.

3. The active camming device of claim 1, wherein the first cam lobe includes a concave shape region in which the axis of concavity is substantially perpendicular to the axis of rotation of the first cam lobe.

4. The active camming device of claim 3, wherein the first concave cam surface is disposed on the concave shape region of the first cam lobe such that the axis of concavity of the first concave cam surface is substantially perpendicular to the axis of concavity of the concave shape region.

5. The active camming device of claim 1, wherein the first concave cam surface includes a plurality of independent cam lobes which are shaped to form a combined concave camming surface.

6. The active camming device of claim 1, wherein the second cam surface is shaped in a convex manner, and wherein the axis of convexity of the second cam surface is substantially parallel to the axis of rotation of the first cam lobe.

7. The active camming device of claim 1, wherein the second cam surface includes a plurality of independent cam lobes which are shaped to form a combined camming surface.

8. The active camming device of claim 1, wherein the first concave cam surface and the second cam surface each include a cam lobe which are asymmetric from one another.

9. The active camming device of claim 1, wherein the first concave cam surface and the second cam surface each include a cam lobe which are different widths from one another.

10. The active camming device of claim 1, wherein the first concave cam surface and the second cam surface each include a cam lobe which only contacts the at least one terminal.

11. The active camming device of claim 1, wherein the first concave and second cam surfaces include sidewalls, and wherein the sidewalls of the first concave and second cam surface are misaligned from one another.

12. The active camming device of claim 1, wherein the at least one terminal includes two terminals positioned on either side of the first concave and second cam surfaces.

13. The active camming device of claim 1 further including an axle coupling the first concave cam surface to the second cam surface.

14. The active camming device of claim 1 further including two axles, wherein each axle couples a portion of the first concave cam surface to a portion of the second cam surface.

15. The active camming device of claim 1, wherein an axis of concavity of the first concave cam surface is perpendicular to the longest axis of the active camming device.

16. The active camming device of claim 6, wherein the axis of convexity of the second cam surface is perpendicular to the longest axis of the active camming device.

17. The active camming device of claim 1, wherein first concave cam surface and the second cam surface are oriented such that when the active camming device is inserted into an appropriately sized taper, three points of contact are made between the active camming device and the appropriately sized taper.

18. The active camming device of claim 1, wherein the connection system includes:

a stem coupled to the at least one terminal; and a clip-in point coupled to the stem.

19. The active camming device of claim 1, wherein the retraction system includes:

at least two trigger wires coupled independently to the first concave and second cam surfaces; and at least one spring coupled to the first concave and second cam surfaces.

20. A method for camming an active camming device in an orifice comprising:

providing an active camming device comprising:

at least one terminal;

a first concave cam surface coupled to the at least one terminal, wherein the first concave cam surface includes a first cam lobe, and wherein the axis of concavity of the first cam surface is substantially parallel to an axis of rotation of the first cam lobe;

a second cam surface coupled to the at least one terminal, wherein the second cam surface is oriented opposite the first concave cam surface;

a connection system coupled to the at least one terminal; and a retraction system coupled to the first concave cam surface and the second cam surface such that the first concave and second cam surfaces are spring biased in a particular position;

retracting the spring biased retraction system such that the first concave and second cam surface on the active camming device are retracted circularly away from one another, wherein the axis of concavity of the first concave cam surface is substantially parallel to the axis of circular retraction between the first concave and second cam surface;

inserting the active camming device into the orifice; and releasing the retraction system thereby allowing the first concave and second cam surfaces to circularly move toward one another causing the first concave cam surface to contact the orifice at least two points and the second cam surface to contact the orifice at least one point.

21. The method of claim 20, wherein retracting a spring biased retraction system further includes:

gripping a trigger mechanism spring biased into an extended position; and retracting the trigger mechanism causing the first concave and second cam surface to rotate around an axis of rotation.

22. The method of claim 20, wherein releasing the retraction system further includes releasing pressure on a trigger mechanism that is spring biased thereby allowing the first concave and second cam surfaces to rotate around an axis of rotation, and causing the first concave cam surface to contact the orifice at at least two points and the second cam surface to contact the orifice at at least one point.

23. An active camming device comprising:

at least one terminal;

a first convex cam surface coupled to the at least one terminal, wherein the first convex cam surface includes a first cam lobe, and wherein the axis of convexity of the first cam surface is substantially parallel to an axis of rotation of the first cam lobe;

a second cam surface coupled to the at least one terminal, wherein the second cam surface is oriented opposite the first convex cam surface;

a connection system coupled to the at least one terminal; and a retraction system coupled to the first convex cam surface and the second cam surface such that the first convex and second cam surfaces are spring biased in a particular position.

24. The active camming device of claim 23, wherein the axis of rotation of the first cam lobe is substantially parallel to the lengthwise orientation of the at least one terminal.

25. The active camming device of claim 23, wherein the first cam lobe includes a concave shape region in which the axis of concavity is substantially perpendicular to the axis of rotation of the first cam lobe.

26. The active camming device of claim 25, wherein the first concave cam surface is disposed on the concave shape region of the first cam lobe such that the axis of concavity of the first concave cam surface is substantially perpendicular to the axis of concavity of the concave shape region.

27. The active camming device of claim 23, wherein the first convex cam surface includes a plurality of independent cam lobes which are shaped to form a combined convex camming surface.

28. The active camming device of claim 23, wherein the second cam surface is shaped in a convex manner, and wherein the axis of convexity of the second cam surface is substantially parallel to the axis of rotation of the first cam lobe.

29. The active camming device of claim 23, wherein the first convex cam surface and the second cam surface each include a cam lobe which are asymmetric from one another.

30. The active camming device of claim 23, wherein the first convex cam surface and the second cam surface each include a cam lobe which are different widths from one another.

31. The active camming device of claim 23, wherein an interior surface of each cam surface only contacts the at least one terminal.

32. The active camming device of claim 23, wherein the first convex and second cam surfaces include sidewalls, and wherein the sidewalls of the first convex and second cam surfaces are misaligned from one another.

33. The active camming device of claim 23, wherein the at least one terminal includes two terminals positioned on either side of the convex and second cam surfaces.

34. The active camming device of claim 23 further including an axle coupling the first convex cam surface to the second cam surface.

35. The active camming device of claim 23 further including two axles, wherein each axle couples a portion of the first convex cam surface to a portion of the second cam surface.

36. The active camming device of claim 23, wherein the axis of convexity of the first convex cam surface is perpendicular to the longest axis of the active camming device.

37. The active camming device of claim 23, wherein the axis of concavity of the second cam surface is perpendicular to the longest axis of the active camming device.

38. The active camming device of claim 23, wherein the first convex cam and the second cam surfaces are oriented such that when the active camming device is inserted into an appropriately sized taper, three points of contact are made between the active camming device and the appropriately sized taper.

39. The active camming device of claim 23, wherein the connection system includes:

a stem coupled to the at least one terminal; and a clip-in point coupled to the stem.

40. The active camming device of claim 23, wherein the retraction system includes:

at least two trigger wires coupled independently to the first convex and second cam surfaces; and at least one spring coupled to the first convex and second cam surfaces.

41. A method of camming an active camming device in an orifice comprising:

providing an active camming device comprising:

at least one terminal;

a first convex cam surface coupled to the at least one terminal, wherein the first convex cam surface includes a first cam lobe, and wherein the axis of convexity of the first cam surface is substantially parallel to an axis of rotation of the first cam lobe;

a second cam surface coupled to the at least one terminal, wherein the second cam surface is oriented opposite the first convex cam surface;

a connection system coupled to the at least one terminal; and a retraction system coupled to the first convex cam surface and the second cam surface such that the first convex and second cam surfaces are spring biased in a particular position, retracting the spring biased retraction system such that the first convex and second cam surface on the active camming device are retracted circularly away from one another, wherein the axis of concavity of the first concave cam surface is substantially parallel to the axis of circular retraction between the first concave and second cam surface;

inserting the active camming device into the orifice; and releasing the retraction system thereby allowing the first convex and second cam surfaces to circularly move toward one another causing the first convex cam surface to contact the orifice at least one point and the second cam surface to contact the orifice at least two points.

42. The method of claim 41, wherein retracting a spring biased retraction system further includes:

gripping a trigger mechanism spring biased into an extended position; and retracting the trigger mechanism causing the first convex and second cam surfaces to rotate around an axis of rotation.

43. The method of claim 41, wherein releasing the retraction system further includes releasing pressure on a trigger mechanism that is spring biased thereby allowing the first convex and second cam surfaces to rotate around an axis of rotation, and causing the first convex cam surface to contact the orifice at at least one points and the second cam surface to contact the orifice at at least two points.

* * * * *